United States Patent [19]

Stull

[11] 3,977,815

[45] Aug. 31, 1976

[54] PORTABLE APPARATUS FOR COMPRESSING GASES SUCH AS AIR

[76] Inventor: James C. Stull, Rte. 1, Vinegar Bend, Ala. 36584

[22] Filed: Apr. 24, 1974

[21] Appl. No.: 463,750

[52] U.S. Cl. ..... 417/323; 60/404; 417/375; 417/405

[51] Int. Cl.[2] ..... F04B 17/00

[58] Field of Search ..... 417/405, 323, 234, 375, 417/211; 60/404

[56] References Cited

UNITED STATES PATENTS

| | | | |
|---|---|---|---|
| 259,514 | 6/1882 | Enbom et al. | 417/323 |
| 610,790 | 9/1898 | Beckers | 417/405 |
| 742,342 | 10/1903 | Mohler | 417/234 |
| 865,019 | 9/1907 | Dellanna | 417/323 |
| 915,950 | 3/1909 | Gibson | 417/234 |
| 1,134,215 | 4/1915 | Morse | 417/323 |
| 1,217,797 | 2/1917 | Mack et al. | 417/405 |
| 1,233,855 | 7/1917 | Eidson et al. | 417/405 |
| 1,250,474 | 12/1917 | Lee | 417/234 |
| 1,280,276 | 10/1918 | Morse | 417/323 |
| 1,379,515 | 5/1921 | Bell | 417/405 |
| 1,775,759 | 9/1930 | Grant | 417/405 |
| 1,798,646 | 3/1931 | Anderson | 417/405 |
| 1,853,368 | 4/1932 | MacFadden | 417/234 |
| 1,963,256 | 6/1934 | Bickerstaff | 417/323 |
| 3,558,901 | 1/1971 | Jacobus | 60/404 |
| 3,675,112 | 7/1972 | Smith | 60/404 |

FOREIGN PATENTS OR APPLICATIONS

| | | | |
|---|---|---|---|
| 250,325 | 9/1926 | Italy | 417/323 |

*Primary Examiner*—C. J. Husar

[57] ABSTRACT

Portable apparatus is provided for compressing gases such as air. The apparatus preferably includes a massive fly wheel, a gas compressor and a compressed gas storage vessel mounted on a portable platform. The fly wheel is rotatably mounted whereby it may be rotated by a temporary outside source of power and then the momentum thereof is used to power the gas compressor. The resulting compressed gases may be stored temporarily in the compressed gas storage vessel and thereafter used to power compressed air tools or other apparatus, or for other purposes requiring a source of compressed gases. Excess compressed gases not needed for other purposes may be used to drive the fly wheel and thereby keep it rotating for a maximum period of time. The apparatus does not require an outside souce of power once the fly wheel is rotating at a satisfactory speed and thus thereafter it may be transported to a desired site and used to compress gases without causing a pollution problem.

4 Claims, 4 Drawing Figures

PORTABLE APPARATUS FOR COMPRESSING GASES SUCH AS AIR

BACKGROUND OF THE INVENTION

The present invention is broadly related to apparatus for compressing gases. In one of its more specific embodiments, a portable apparatus is provided for compressing air which does not require an outside source of power at the site of use.

A wide variety of apparatus has been proposed heretofore for compressing gases. However, in almost every known instance, the apparatus requires an outside source of power when in use. Also, the apparatus often tends to pollute the surrounding environment at the site of use due to the outside power requirements.

The present invention overcomes the aforementioned and other disadvantages of the prior art apparatus. The apparatus of the present invention does not require an outside source of power and thus is entirely non-polluting at the site of use. The present apparatus also has many other advantages which will be apparent from the description appearing hereinafter.

BRIEF DESCRIPTION OF THE VARIOUS FIGURES OF THE DRAWINGS

DETAILED DESCRIPTION OF THE INVENTION INCLUDING PREFERRED EMBODIMENTS THEREOF

Figure 1:
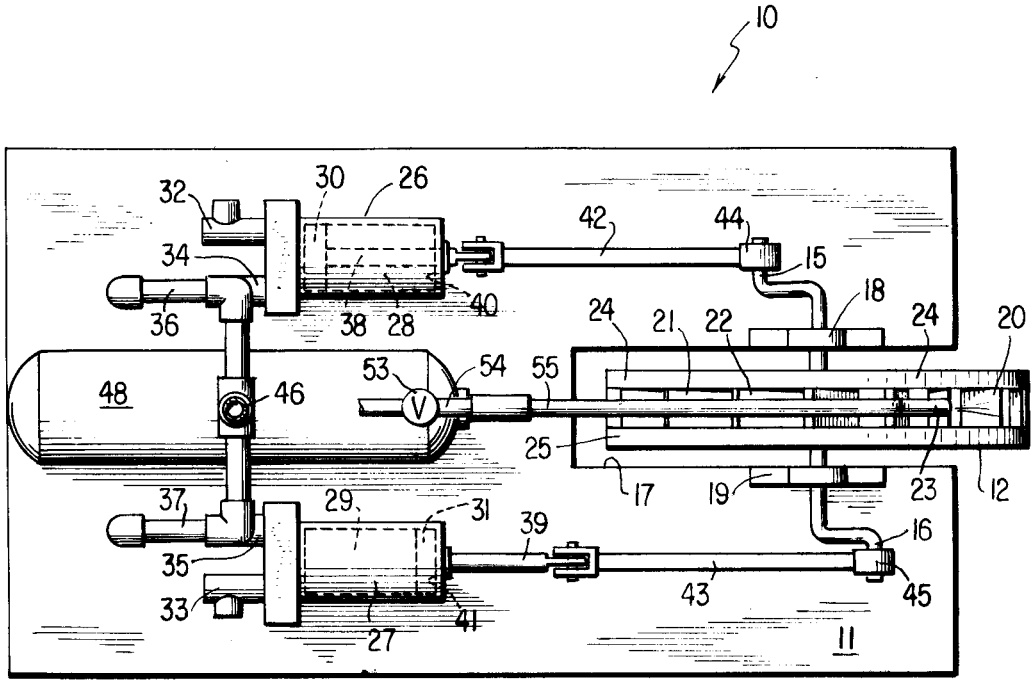
FIG. 1 is a top view of the apparatus of the invention for compressing gases, with the compressed gas storage tank being omitted in the interest of clarity.

Referring now to the drawings, which illustrate one presently preferred embodiment of the invention, the apparatus for compressing gases generally designated as 10 is mounted on a platform 11 whereby it may be easily transported to the site of use. The apparatus 10 includes a heavy fly wheel 12 fixedly mounted on shaft 14 which extends through the center thereof. The ends of shaft 14 terminate in crank-like end portions 15 and 16 which are circumferentially spaced 180° apart. In the interest of simplifing the discussion, the gases to be compressed hereinafter will be air. However, it is understood that a wide variety of other gases may be compressed.

The platform 11 has a slot 17 of a length and width to receive the fly wheel 12. The shaft 14 is rotatably mounted on each end in substantially friction free mounting members 18 and 19 positioned on either side of slot 17. The mounting members 18 and 19 are fixedly attached on their lower ends by conventional attaching means (not shown) to the upper surface of platform 11 and extend upward therefrom a distance sufficient to prevent the lower edge of fly wheel 12 from extending to the bottom of slot 17. This arrangement allows the flywheel 12 to be vertically mounted for rotation in slot 17 and thus the lower rotating edge thereof does not touch the ground or other fixed object which would slow the speed of rotation.

Figure 2:
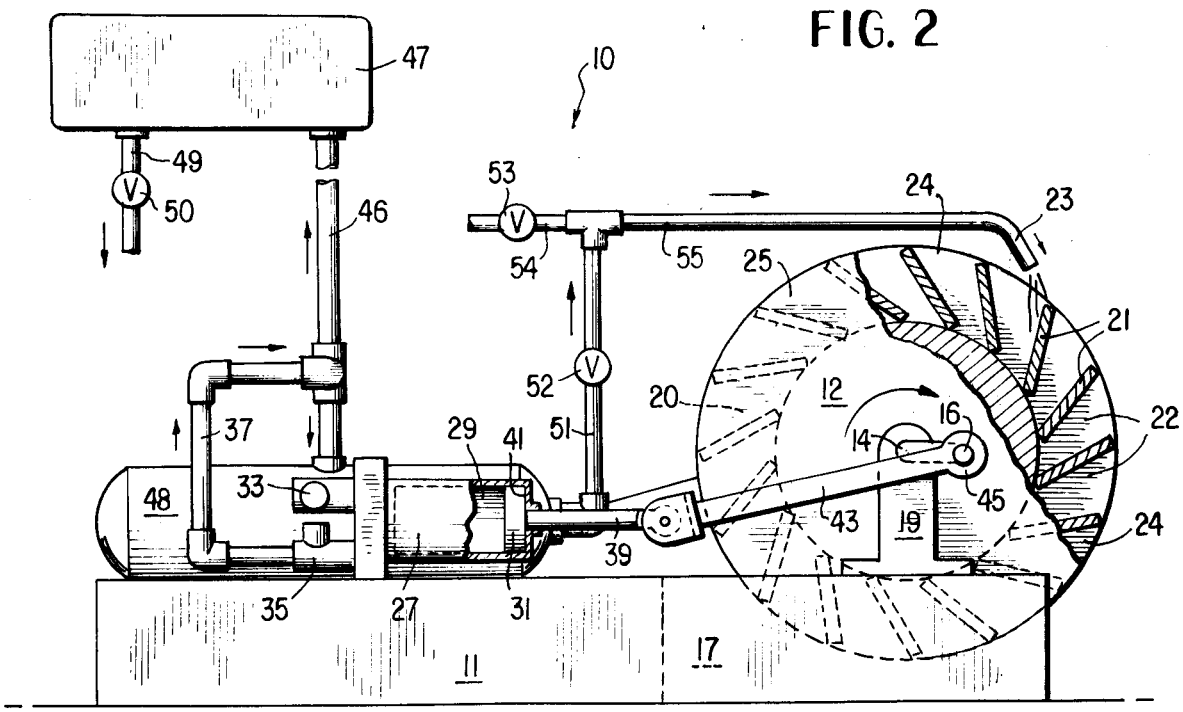
FIG. 2 is a side view of the apparatus of FIG. 1, with the compressed gas storage tank being shown thereabove and the conduit leading to the storage tank being broken away in the interest of simplifying the drawing.
Figure 3:
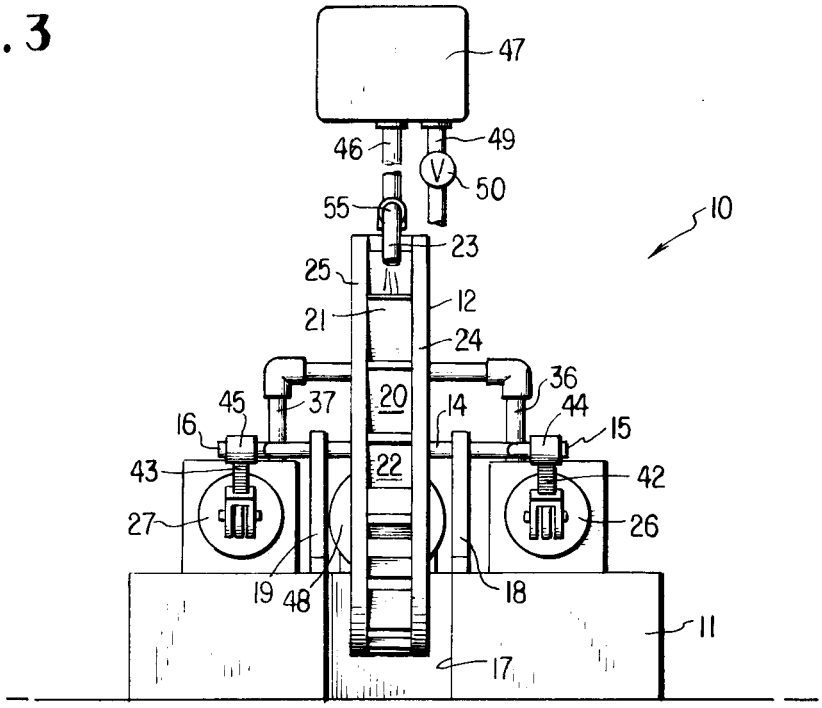
FIG. 3 is a front view in elevation of the apparatus of FIG. 2.
Figure 4:
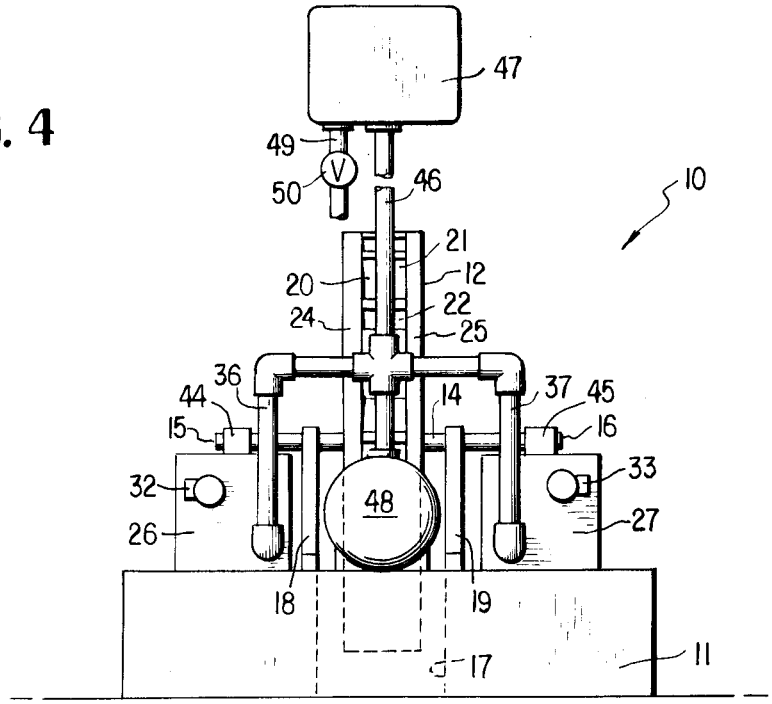
FIG. 4 is a rear view in elevation of the apparatus of FIG. 2.

The fly wheel 12 has a centrally located circumferentially extending slot 20. As is best seen in FIG. 2, the slot 20 extends only partially through the radius of fly wheel 12 and has air vanes 21 mounted or formed therein. The air vanes 21 may be sloped outward in a direction opposite to that of the rotation of fly wheel 12. This arrangement forms sloped air pockets 22 between vanes 21 for receiving air under pressure from nozzle 23.

The vanes 21 are fixedly attached along their lower edges to the bottom of slot 20, and along each of their ends to the internal surfaces of side walls 24 and 25 of slot 20. The compressed air from nozzle 23 rapidly flows into the air pockets 22 as is best seen in FIG. 2, and the force thereof is applied to the air vanes 21 and tends to cause the fly wheel 12 to rotate in the direction of the arrow.

A pair of conventional piston-type compressors 26 and 27 are mounted by prior art mounting means (not shown) on the upper surface of platform 11. The compressors 26 and 27 include cylinders 28 and 29 having substantially friction free and ring free air tight pistons 30 and 31, respectively, reciprocally mounted therein. One way air intake valves 32 and 33 admit air under ambient pressure into cylinders 38 and 39, respectively, and one way outlet valves 34 and 35 allow air under pressure to be forced therefrom into outlet conduits 36 and 37, respectively. The pistons 30 and 31 have piston rods 38 and 39 which pass through air tight openings 40 and 41, respectively, in cylinders 36 and 27. The outer ends of piston rods 38 and 39 are flexibly attached to the inner ends of connecting rods 42 and 43, respectively, and the outer ends thereof have substantially frictionless bearings 44 and 45 in which shaft end portions 15 and 16, respectively, are mounted. As is best seen in FIGS. 1 and 2, at any given time this arrangement allows one compressor 26 or 27 to alternately intake low pressure air via intake valve 32 or 33 into cylinder 28 or 29, respectively, and the other compressor 26 or 27 to alternately discharge compressed air from cylinder 28 or 29 via outlet valve 34 or 35 into outlet conduit 36 or 37, respectively.

The outlet conduits 36 and 37 discharge into conduit 46. The upper end of conduit 46 discharges into upper compressed air storage vessel 47, and the lower end thereof discharges into lower compressed air storage vessel 48. Compressed air for operating compressed air tools or other apparatus (not shown), or for other purposes is withdrawn from storage vessel 47 via conduit 49 upon opening valve 50. Compressed air not needed for operating tools and the like is withdrawn from storage vessel 48 via conduit 51 upon opening valve 52, and upon closing valve 53 in conduit 54, is passed via conduit 55 to nozzle 23 and discharged at high velocity into air pockets 22. Conduit 54 may be temporarily connected to a high pressure source of air at the time of commencing to rotate fly wheel 12. In such instances, upon closing valve 52 and opening valve 53, high pressure air is passed via conduits 54 and 55 to nozzle 23 and discharged into air pockets 22 against air valves 21 to thereby cause fly wheel 12 to rotate rapidly. The apparatus may be transported to the location of use at this time, if desired, and then used to compress air. Alternatively, the fly wheel may be rotated by a temporary outside source of power after transporting the apparatus to the site.

The rotating fly wheel 12 drives the compressors 26 and 27 and compressed air is supplied to storage tanks 47 and 48 via conduits 36, 37 and 46. Upon opening valve 50 and closing valve 52, all of the compressed air is used to power tools and the like. However, all or a portion of the compressed air may be used to keep fly wheel 12 rotating by opening valve 52 and closing valve 53 and partially opening or closing valve 50 as desired.

The fly wheel 12 preferably is extremely heavy and may weigh many hundreds, or even thousands, of pounds. The massive rapidly rotating fly wheel 12 has tremendous momentum and continues to rotate and provide power for compressing the air for a long period of time as it is mounted on substantially frictionless bearings and the substantially frictionless or ringless pistons do not cause undue drag. The period of rotation may be maximized by using all or a part of the compressed air to keep the fly wheel 12 rotating as described above. The terms "friction free" and "frictionless" are used herein in accordance with prior art practice when referring to bearings, mounting members and rotating and/or reciprocating members in general wherein friction has been reduced to a practical minimum thereby rendering the same substantially friction free and/or substantially frictionless. As is recognized and understood by those skilled in this art, terms such as friction free and frictionless are not used to refer to an absolute absence of friction, which is well known to be impossible, but rather these terms refer to a practical minimum amount of friction.

The foregoing detailed description and the various figures of the drawings are for purposes of illustration only, and are not intended to restrict the scope or spirit of the appended claims.

I claim:

1. Apparatus for compressing gases comprising support means, substantially friction-free spaced mounting members supported by the said support means, a rotatable massive flywheel fixedly mounted on a shaft, the said shaft having spaced end portions which extend outward from the flywheel, the said spaced end portions of the shaft being rotatably mounted in the said spaced mounting members whereby the said flywheel is capable of being rotated rapidly with substantially no friction, means actuated by an outside source of power for initially rapidly rotating the flywheel, the said means for rapidly rotating the flywheel being rendered ineffective after the flywheel is rotating at a sufficiently rapid rate whereby the momentum of the flywheel is the sole ultimate source of power available for operating the apparatus, a compressor for gases carried by the support means, the compressor including compressor means adapted to be powered solely by the momentum of the rapidly rotating flywheel, means for supplying low pressure gas to the compressor, means powered solely by the momentum of the rapidly rotating flywheel for driving the compressor and thereby compressing the low pressure gas to a relatively high pressure, first conduit means for withdrawing the compressed high pressure gas from the compressor, vessel means carried by the said support means for containing the withdrawn compressed high pressure gas, the said first conduit means for withdrawing the compressed high pressure gas including additional conduit means for passing the same into the said vessel means, second conduit means for withdrawing compressed high pressure gas from the said vessel means and for passing the same to a compressed gas operated device whereby the said device is operated thereby, the said first conduit means for withdrawing the compressed high pressure gas from the compressor and the said second conduit means for withdrawing the compressed gas from the vessel means being in communication with the interior of the said vessel means at points which are in spaced relationship and being capable of supplying high pressure compressed gas to the vessel means at one of said spaced points and withdrawing the same from the vessel means at the other of said spaced points, the said rapidly rotating flywheel having air vanes in the circumference thereof whereby a stream of high pressure gas may be directed against the air vanes to increase the speed of rotation of the flywheel or maximize the period of rotation of the flywheel, and third conduit means for withdrawing high pressure compressed gas from the said vessel means and for directing a stream of the high pressure compressed gas against the said air vanes to thereby increase the speed of rotation or maximize the period of rotation of the flywheel.

2. The apparatus of claim 1 wherein the said support means is a portable platform whereby the apparatus mounted thereon may be easily transported to the site of use.

3. The apparatus of claim 2 wherein the said platform has a slot therein and the flywheel is rotatably mounted in the slot.

4. The apparatus of claim 1 wherein the said second conduit means for withdrawing high pressure compressed gas from the vessel means also includes additional conduit means for supplying a stream of the high pressure compressed gas to a device operated thereby other than the said flywheel.

* * * * *